US005469640A

United States Patent [19]

Nichols

[11] Patent Number: 5,469,640

[45] Date of Patent: Nov. 28, 1995

[54] QUICK ADJUSTING SHOE LACING SYSTEM

[75] Inventor: Steven B. Nichols, Los Angeles, Calif.

[73] Assignee: K-Swiss Inc., Chatsworth, Calif.

[21] Appl. No.: 425,213

[22] Filed: Apr. 18, 1995

Related U.S. Application Data

[63] Continuation of Ser. No. 198,289, Feb. 18, 1994, abandoned.

[51] Int. Cl.[6] ..... A43B 11/00

[52] U.S. Cl. ..... 36/50.1; 24/306; 24/712; 24/712.1

[58] Field of Search ..... 36/50.1, 50.5; 24/306, 442, 712, 712.1

[56] References Cited

U.S. PATENT DOCUMENTS

| | | | |
|---|---|---|---|
| 1,088,067 | 2/1914 | Forbes | 36/50.1 |
| 2,266,083 | 12/1941 | Rzepa | 24/712.1 |
| 3,009,221 | 11/1961 | Firari | 36/50.1 |
| 3,279,015 | 10/1966 | Henning | 36/50.1 |
| 4,081,916 | 4/1978 | Salisbury | 36/50.1 |
| 4,282,657 | 8/1981 | Antonious | 36/50.1 |
| 4,282,659 | 8/1981 | Borque et al. | 36/50.1 |
| 4,308,672 | 1/1982 | Antonious | 24/306 |
| 4,414,761 | 11/1983 | Mahood | 24/712 |
| 5,027,482 | 7/1991 | Torppey | 24/306 |
| 5,129,130 | 7/1992 | Lecouturier | 24/712 |

FOREIGN PATENT DOCUMENTS

| | | | |
|---|---|---|---|
| 0003792 | 5/1893 | United Kingdom | 24/712.1 |
| 0020541 | of 1902 | United Kingdom | 36/50.1 |

*Primary Examiner*—Paul T. Sewell
*Assistant Examiner*—Marie Denise Patterson
*Attorney, Agent, or Firm*—I. Morley Drucker; Howard N. Sommers; Daniel R. Kimbell

[57] ABSTRACT

A quick adjusting shoe lacing system. The system has a cinch plate having eyelets which are spaced apart to about the same distance as eyelets formed in the lacing area of the shoe. The shoe laces are laced through the cinch plate eyelets along with the eyelets in the lacing area of the shoe. A strap, fixably attached at a lower end to the shoe and loopable at an upper end through a slot in the cinch plate is used to adjustably pull the cinch plate and the shoe laces looped through its eyelets downwardly and thus increase the shoe lace tension. Alternatively, a latching buckle linked to the cinch place via a wire loop can be used to affect changes in lace tension. These changes in lace tension can be affected even after the shoe laces are laced and tied up, offering the ability to make quick and fine adjustments to shoe laces.

18 Claims, 2 Drawing Sheets

QUICK ADJUSTING SHOE LACING SYSTEM

BACKGROUND OF THE INVENTION

This application is a continuation of application Ser. No. 08/198,289 filed Feb. 18, 1994, now abandoned.

1. Field of the Invention

This invention generally relates to the field of lacing systems for shoes, and particularly to a quick adjusting shoe lacing system which allows the shoes to be placed on the wearer's feet, laced up and tied, and then be further adjusted to more precisely fit the shoe to the wearer's feet.

2. Description of the Prior Art

There are many shoe lacing systems which allow shoe laces to be tightened quickly. One such system is that of U.S. Pat. No. 3,200,458 to Marzocchi. Marzocchi discloses a shoe lace tightening device which has closing lever, including eyelets for engaging with the shoe laces. The closing lever is pivotally joined via lever arms to a plate riveted to one quarter side of the upper. When the closing lever is flipped up, the shoe lace tension is released. When it is flipped down onto the plate, shoe lace tension will be increased, thereby tightening the shoe laces. Several problems exist with the design of the Marzocchi system. First, when it is activated, it only allows for a single predetermined degree of lace tautness. Second, its design would appear to be susceptible to sudden disengagement. Third, it does not have a grip to aid in engaging and disengaging the closing lever.

U.S. Pat. Nos. 4.081,916; 4,414,761; and 5,027,482 to Salisbury, Mahood, and Torppey, respectively, each disclose quick lacing shoe lace systems that rely on laces being looped to one side of the lacing area of the shoe and on the other side of the lacing area to a pulling patch of material with hook and loop material, such a Velcro®. When the pulling patch is attached to the opposite side of the lacing area of the shoe, tension will be placed on the laces. One major drawback to these prior art systems is that they have no provision to make fine adjustments in the lace tension after the shoe is worn. Also, when these shoes are in a disengaged state, the pulling patch of material will normally hang off the shoe in an unattractive manner. U.S. Pat. Nos. 3,009,221 and 3,351,985 to Firari, and Lollmann, respectively, each disclose shoes having ski-boot type latches. These references do not teach lacing system to be used in conjunction with shoe laces, nor systems that provide for post-lacing adjustment of the shoes.

There accordingly remains a need for a shoe lacing system for use with shoe laces which permits the shoe lace tightness, and shoe fit, to be further and finely adjusted even after the shoe laces are laced up and tied.

SUMMARY OF THE INVENTION

The invention disclosed herein solves the problems discussed above by providing a quick adjusting shoe lacing system which is easy to use and allows for further precise adjustment of shoe lace tension in a single movement, even after the shoe laces are laced up and tied.

The invention provides a quick adjusting shoe lacing system for use in a shoe having an upper, a sole, and utilizing shoe laces which are laced through a plurality of spaced apart eyelet means in a lacing area of the shoe, said quick adjustment shoe lacing system comprising:

a cinch member having a plurality of spaced apart eyelets at an upper region, said eyelets being spaced apart by approximately the same distance as are said eyelet means in the lacing area of the shoe, wherein said cinch member is placed adjacent said upper, and said shoe laces are laced through the eyelet means of the shoe and through said eyelets in said cinch member; and a means to releasably retain and move said cinch member from a first position wherein its eyelets are generally aligned with at least some of said eyelet means, to at least one other lower position where said cinch member is releasably retained, such that said cinch member will exert pulling force on said shoe laces of said shoe, and thereby selectively offer additional shoe lace tension, which tension can be placed on said shoe laces even after said laces are laced.

The invention further provides a quick adjusting shoe lacing system, wherein said shoe having shoe laces which are laced through eyelet means located on medial and lateral sides of the upper of the shoe to define a lacing area of the shoe, and a sole, said quick adjusting shoe lacing system comprising:

a cinch plate having a plurality of spaced apart eyelets at an upper region, said eyelets being spaced apart by approximately the same distance as said eyelets means, and a slot at a lower region, wherein said cinch plate is positioned on at least one of the medial and lateral sides of the shoe such that the eyelets of the cinch plate are generally aligned with at least some of the eyelet means, and said laces are lacedly engaged with said eyelet means and said eyelets of the cinch plate; and a strap means, fixed at a lower, first end to the upper, and a free, second end which is looped through the slot in the cinch plate and folded over onto itself, where complementary hook and loop material is attached to provide for releasable retention, wherein when said cinch plate is drawn downwardly by pulling on the strap means, the shoe laces looped through the eyelets in the cinch will also be pulled, thereby causing them to be tightened to the degree desired by the wearer.

The invention yet further provides a shoe having a quick adjusting shoe lacing system, said shoe having shoe laces which are laced through eyelet means located on medial and lateral sides of the upper of the shoe to define a lacing area of the shoe, and a sole, said quick adjusting shoe lacing system comprising:

a cinch plate having a plurality of spaced apart eyelets at an upper region, said eyelets being spaced apart by approximately the same distance as said eyelets means, and a slot at a lower region, wherein said cinch plate is positioned on at least one of the medial and lateral sides of the shoe such that the eyelets of the cinch plate are generally aligned with at least some of the eyelet means, and said laces are lacedly engaged with said eyelet means and said eyelets of the cinch plate; and a strap means, fixed at a lower, first end to the upper, and a free, second end which is looped through the slot in the cinch plate and folded over onto itself, where complementary hook and loop material is attached to provide for releasable retention, wherein when said cinch plate is drawn downwardly by pulling on the strap means, the shoe laces looped through the eyelets in the cinch will also be pulled, thereby causing them to be tightened to the degree desired by the wearer.

The invention finally provides a shoe having a quick adjusting shoe lacing system, said shoe having shoe laces which are laced through eyelet means located on medial and lateral sides of the shoe to define a lacing area of the shoe, said quick adjusting shoe lacing system comprising:

a cinch plate having a plurality of spaced apart eyelets at an upper region, said eyelets being spaced apart by approximately the same distance as said eyelets means on medial and lateral sides of the shoe, said cinch plate being positioned on the outside of the upper with the shoe laces laced through the eyelet means and cinch plate eyelets;

a latching buckle with an upper and lower end, said lower end being hingedly affixed to one of the medial and lateral sides of the shoe in its quarter region; and a link means with an upper and lower end, said upper end of said link means being pivotally attached to said cinch plate, wherein said latching buckle has at least one attachment point for hingedly receiving said lower end of said link means, whereby when said latching buckle is in a first open position, with its upper end displaced away from the upper of the shoe, the cinch plate will not be pulled downwardly, but when said latching buckle is in a closed position, with its upper end lying adjacent the upper of the shoe, said cinch plate will be pulled downwardly by said link means, and will thus exert additionally pulling force on said shoe laces looped through said cinch plate.

DESCRIPTION OF THE PREFERRED EMBODIMENT

Figure 1:
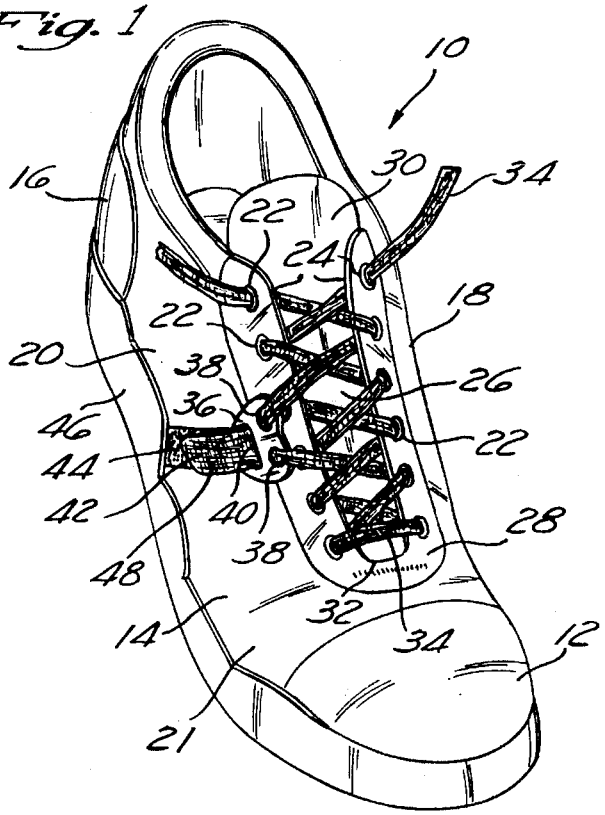
FIG. 1 is a top plan view of a shoe with a first embodiment of the quick adjusting shoe lacing system.

As shown in FIG. 1, a shoe 10 has, respectively, a front portion, termed a vamp 12, a mid-section called quarter 14, and a rear section of the shoe 10 where the heel and lower ankle seat, known as the counter 16. The vamp 12, quarter 14, and counter 16 are generally referred to as the upper 21. The quarter 14 has a medial panel 18 and a lateral panel 20, and each have a series of eyelet means 22 positioned near their edges 24, in a lacing region 26 of the shoe 10. The eyelet means 22 may be formed directly through the quarter panels 18 and 20, or also through an optional eyelet piece 28 attached in the vicinity of the lacing region 26 of the shoe 10. As used herein, the term "eyelet means" 22 encompasses conventional eyelets, rings, shoe lace hitches, and the like. A shoe tongue 30 underlies the upper regions of the quarter panels 18 and 20 and is attached at a leading edge 32 to the vamp 12. Conventional shoe laces 34 are provided.

Figure 4:
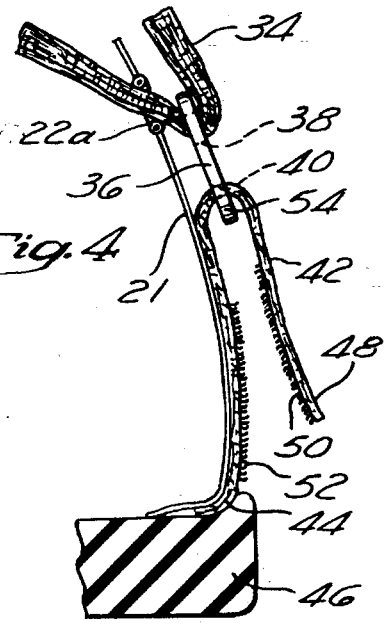
FIG. 4 is a first cross-sectional view of the shoe along lines 4—4, of FIG. 2 Showing the lacing strap without tension.
Figure 3:
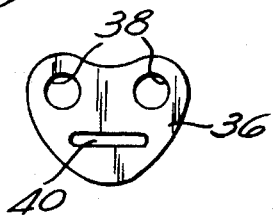
FIG. 3 is a top view of the cinch member used for the first embodiment of the quick adjusting shoe lacing system.
Figure 5:
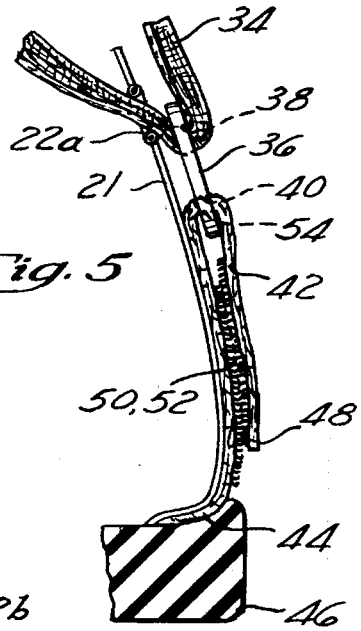
FIG. 5 is a second cross-sectional view along lines 4—4 of FIG. 2, where the cinch plate is cinched up.
Figure 2:
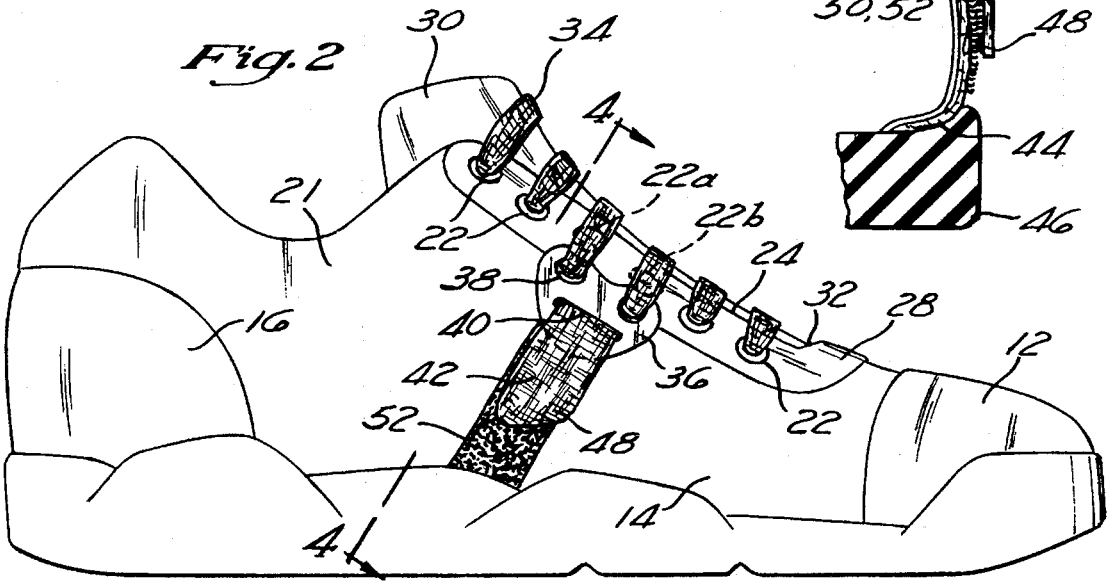
FIG. 2 is a side, view of the shoe of FIG. 1.

Continuing to refer to FIG. 1, and to FIGS. 2 and 3 as well, a first embodiment of the system is shown. A lacing cinch member 36 is provided. It floats on the outside of the upper 21 and has a plurality of spaced apart cinch member eyelets 38 on its upper region, and a slot 40 at a lower region. The cinch member eyelets 38 are spaced apart such as to allow the shoe laces 34 to be laced through aligned cinch member eyelets 38 and eyelet means 22, as is best shown in FIGS. 4 and 5. An adjustment strap 42 is attached at its lower region 44 at or near the mid-sole 46 of the shoe 10. The upper end 48 of the adjustment strap 42 will be laced through the slot 40 in the cinch member 36, and folded back onto itself. The presence of complementary hook and loop material 50 and 52 permits the adjustment strap 42 to be folded over onto itself at any number of degrees, to thereby adjust the position of the lacing inch member 36. By changing the distance between the lower region 44 of the adjustment strap 42 and the point 54 where it loops through the slot 40 in the lacing cinch member 36, the lacing cinch member 36 can be moved up or down on the upper 21, closer or further away from the lacing region 26 of the shoe. For example, referring to FIG. 4, when the lacing cinch member 36 is generally aligned with its eyelets 38 in line with the eyelet means **22*a* and 22*b*, the shoe laces 34 will not be pulled, and no addition lacing tension will be placed on the shoe laces 34. However, when the lacing cinch member 36 is pulled closer to the mid-sole 46, as shown in FIG. 5, the cinch member eyelets 38 will pull on the laces 34 looped therethrough, and thereby provide additional lace tension in the vicinity of the lacing cinch member 36. The lacing cinch system of FIGS. 1–5 thus allows for quick and "fine" adjustment of the shoe lace tension, even after the shoe laces 34** are laced up.

Figure 6:
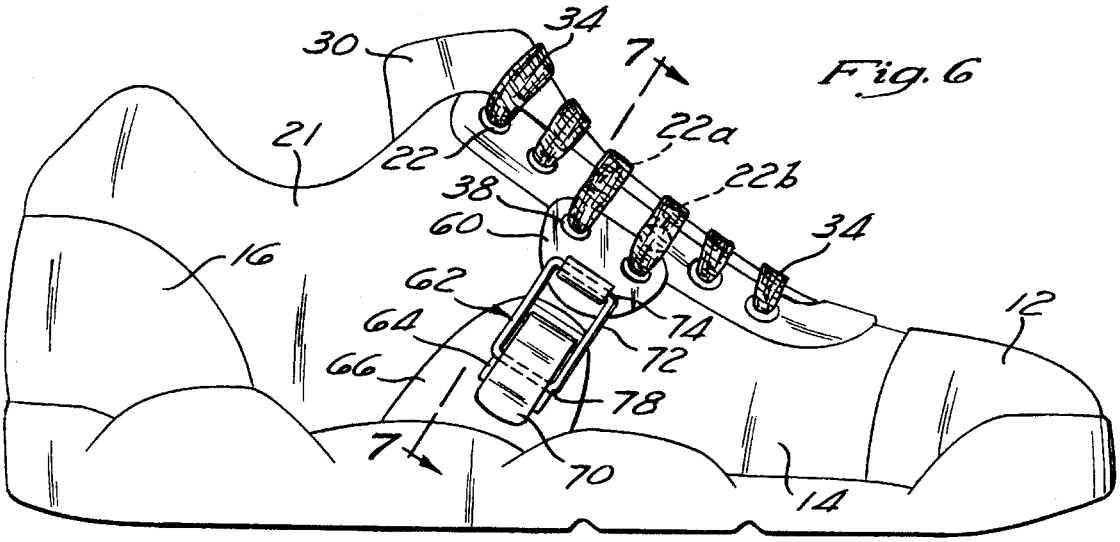
FIG. 6 is a side view of a second embodiment of the quick adjusting shoe lacing system.
Figure 7:
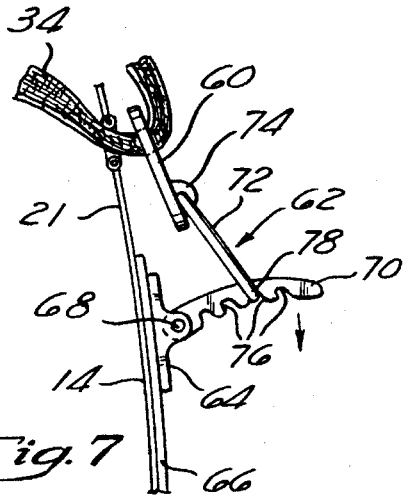
FIG. 7 is a first cross-sectional view along lines 6—6 of FIG. 6, with its latching buckle with multiple cutouts in an open position.
Figure 8:
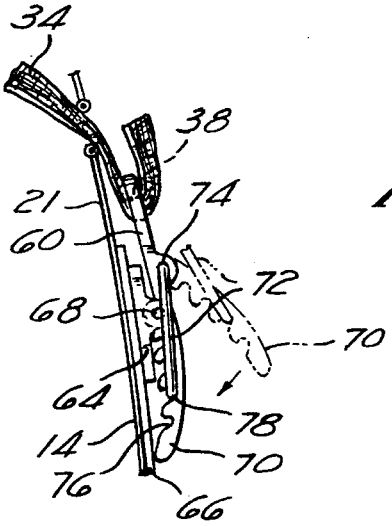
FIG. 8 is a second cross-sectional view of FIG. 6, with its latching buckle in a locked position.

A second embodiment of the quick adjusting shoe lacing system is shown in FIGS. 6–8. In this embodiment, in lieu of using an adjustment strap with hook and loop material to adjust the position of its cinch member 60, a ski-boot type latching buckle 62 is used. The latching buckle 62 comprises a base portion 64 which is fixably attached to the quarter 14 of the shoe, preferably on a reinforcing patch of material 66. Hinged to the base portion 64 at hinging point 68 is a latch portion 70. A wire loop 72 is permanently and hingeably attached at a first end 74 to the cinch member 60. The latch portion 70 has a series of spaced apart cutouts 76. The lower end 78 of the wire loop 72 is sized to permit engagement with any one of these cutouts 76. When the latch portion 70 is brought to its locking position of FIG. 8 from its open position shown in FIG. 7, the wire loop 70 will thus be pulled, and will pull the cinch member 72 downwardly closer to the mid-sole of the shoe 10. By selecting a cutout 76 closer or further away from the hinging point 68 of the latch portion 70, the degree to which the cinch member 60 will be pulled down, and thus the extra pulling tension on the shoe laces 34 can thus be easily selected. In the fully closed position of FIG. 8, the latching buckle 70 will be securely locked until it is opened by the shoe wearer.

Figure 9:
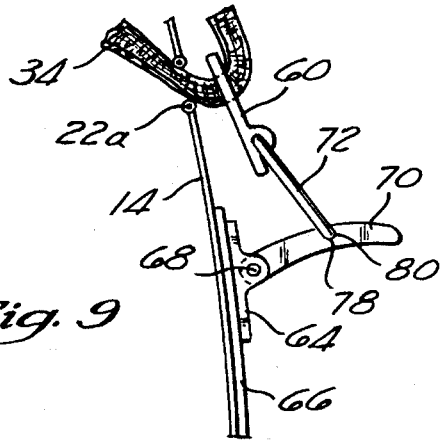
FIG. 9 is a third cross-sectional view of a shoe shown in FIG. 6 with a third embodiment of the quick adjusting shoe lace system, where the wire loop has a single preset pivot point on the latching buckle, and the latching buckle is in an open position.
Figure 10:
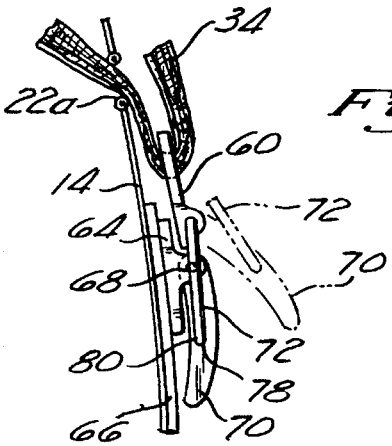
FIG. 10 is a fourth cross-sectional view of FIG. 6 showing the third embodiment of the quick adjusting shoe lace system, with its latching buckle in a locked position.

FIGS. 9 and 10 show a third embodiment of the quick adjusting shoe lacing system, similar in most respects to that shown in FIGS. 7 and 8 and described above. In this third embodiment, instead of having a plurality of cutouts, the lower end 78 of the wire loop 72 is pivotally engaged at a single unadjustable position 80. As a result of the lower end 78 of the wire loop 72 being fixed at a single, unchangeable point on the later portion 70, only a single degree of the shoe lace tension adjustment can be achieved with this embodiment. In all other respects, this third embodiment is the same as the second embodiment.

The quick adjusting shoe lace systems depicted in the Figures each use cinch plates 36 and 60 with two lace eyelets 38. However, three or more eyelets 38 can be used if desired. Also, while the cinch plates 36 and 60 are pictured as placed on only one side of the shoe, they can be placed on either or both sides of the shoe.

While it is preferable for the cinch members 38 and 60 of the three embodiments to be formed of a generally inflexible and rigid material to avoid deformation under tension, such as provided by a generally rigid and inflexible plastic or metal, soft and more flexible land elastic materials, such as leather, soft rubber and soft plastic can also be used. In fact, flexible and elastic materials can be used if a degree of shoe lace shock absorbency is desired.

It should be borne in mind that the drawings are not rendered in actual scale so that certain features of the invention can be brought out and depicted.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims:

I claim:

1. A shoe with a quick adjusting shoe lacing system, the shoe having an upper with medial and lateral sides, a sole, and utilizing shoe laces which are cross-laced through a plurality of spaced apart eyelet means located on medial and lateral sides in a lacing area of the shoe, said quick adjustment shoe lacing system comprising:

a cinch member having a plurality of spaced apart eyelets at an upper region, said eyelets being spaced apart by approximately the same distance as are said adjacent eyelet means in the lacing area of the shoe, wherein said cinch member is placed adjacent said upper on a first side of the shoe comprising one of its medial and lateral sides, and said shoe laces are laced through the eyelet means of said first side of the shoe and directly through said eyelets in said adjacent cinch member without first being laced through eyelets on the other second side of the medial and lateral side; and a means positioned on said first side of the shoe to releasably retain and move said cinch member from a first upper position wherein its eyelets are generally aligned with at least some of said adjacent eyelet means, to at least one of several other lower positions where said cinch member is releasably retained, such that said cinch member will exert pulling force on said shoe laces of said shoe which are laced through said cinch member, and thereby selectively offer additional shoe lace tension, which tension can be placed on said shoe laces even after said laces are laced.

2. The quick adjusting shoe lacing system of claim 1, wherein said cinch member is formed of a generally rigid material.

3. The quick adjusting shoe lacing system of claim 1, wherein said cinch member is formed of an elastic material, which material gives said cinch member a degree of shock absorbency.

4. The quick adjusting shoe lacing system of claim 1, wherein said cinch member has a slot located on a lower region, and said means to move said cinch member from a first position and retain it in at least one other lower position comprises a strap means with a first end affixed in the vicinity of a lower region of the upper of the shoe, and a free second end, which second end is looped through said slot and pulled down and retained by retention means to cause said cinch member, and the shoe laces looped through its eyelets to be pulled down and thus increase the shoe lace tension.

5. The quick adjusting shoe lacing system of claim 4, wherein said retention means on said strap means comprises complementary hook and loop material.

6. The quick adjusting shoe lacing system of claim 1, wherein said means to move said cinch member from a first upper position and releasably retain it in at least one other, lower position comprises:

a latch buckle having lower and upper ends, said lower ends being hinged at its lower end to the upper of the shoe and a link means connecting said cinch means to said upper end of said latch buckle; and whereby when said latch buckle is in a first open position, with its upper end displaced away from the upper of the shoe, the cinch plate will not be pulled downwardly, but when said latch buckle is in a closed position, with its upper end lying adjacent the upper of the shoe, said cinch plate will be pulled downwardly by said link means, and will thus exert additionally pulling force on said shoe laces looped through said cinch plate.

7. The quick adjusting shoe lacing system of claim 6, wherein said cinch member comprises a rigid cinch plate, and said link means comprises a wire loop which is pivotally connected at one end to said rigid cinch plate and at another end to said latch buckle.

8. The quick adjusting shoe lacing system of claim 7, wherein said latch buckle has a series of spaced apart wire loop cutouts for releaseably retaining said wire loop, wherein by selecting a wire loop cutout closer to or further away from the hinging point of said latch buckle, the degree to which the cinch plate will be pulled down, and thus the degree to which the shoe lace tension will be increased can be adjusted.

9. A shoe having a quick adjusting shoe lacing system, said shoe having shoe laces which are laced through eyelet means located on medial and lateral sides of the upper of the shoe to define a lacing area of the shoe, and a sole, said quick adjusting shoe lacing system comprising:

a cinch plate having a plurality of spaced apart eyelets at an upper region, said eyelets being spaced apart by approximately the same distance as said eyelets means, and a slot at a lower region, wherein said cinch plate is positioned on at least one of the medial and lateral sides of the shoe such that the eyelets of the cinch plate are generally aligned with at least some of the eyelet means, and said laces are lacedly engaged with said eyelet means and said eyelets of the cinch plate; and a strap means, fixed at a lower, first end to the upper, and a free, second end which is looped through the slot in the cinch plate and folded over onto itself, where complementary hook and loop material is attached to provide for releasable retention, wherein when said cinch plate is drawn downwardly by pulling on the strap means, the shoe laces looped through the eyelets in the cinch will also be pulled, thereby causing them to be tightened to the degree desired by the wearer.

10. A shoe having a quick adjusting shoe lacing system, said shoe having shoe laces which are laced through eyelet means located on medial and lateral sides of the shoe to define a lacing area of the shoe, said quick adjusting shoe lacing system comprising:

a cinch plate having a plurality of spaced apart eyelets at an upper region, said eyelets being spaced apart by approximately the same distance as said eyelets means on medial and lateral sides of the shoe, said cinch plate being positioned on the outside of the upper with the shoe laces laced through the eyelet means and cinch plate eyelets;

a latching buckle with an upper and lower end, said lower end being hinged to one of the medial and lateral sides of the shoe in its quarter region; and a link means with an upper and lower end, said upper end of said link means being pivotally attached to said cinch plate, wherein said latch buckle has at least one attachment point for hingedly receiving said lower end of said link means, whereby when said latching buckle is in a first open position, with its upper end displaced away from the upper of the shoe, the cinch plate will not be pulled downwardly, but when said latching buckle is in a closed position, with its upper end lying adjacent the upper of the shoe, said cinch plate will be pulled downwardly by said link means, and will thus exert additionally pulling force on said shoe laces looped through said cinch plate.

11. A quick adjusting shoe lacing system of claim 10, wherein said link means comprises a wire loop.

12. A quick adjusting shoe lacing system of claim 10, wherein said latching buckle comprises a generally planar member with side walls into which said wire loop pivotally engages at at least one point.

13. The quick adjusting shoe lacing system of claim 12, wherein said at least the attachment point for said wire loop comprises a plurality of slots formed into side walls of said latching buckle.

14. A shoe with a quick adjusting shoe lacing system, the shoe having an upper with medial and lateral sides, a sole, and utilizing shoe laces, which are cross-laced through a plurality of spaced apart eyelet means located on medial and lateral sides in a lacing area of the shoe, said quick adjustment shoe lacing system comprising:

a cinch member having a plurality of spaced apart eyelets at an upper region and has a slot located on a lower region, said eyelets being spaced apart by approximately the same distance as are said adjacent eyelet means in the lacing area of the shoe, wherein said cinch member is placed adjacent said upper on one of its medial and lateral sides, and said shoe laces are laced through the eyelet means of the shoe and directly through said eyelets in said adjacent cinch member without first being laced through eyelets on the other of the medial and lateral side and;

a strap means with a first end affixed in the vicinity of a lower region of the Upper of the shoe, and a free second end, said strap means being positioned on a first side of the shoe to releasably retain and move said cinch member from a first upper position wherein its eyelets are generally aligned with at least some of said adjacent eyelet means, to at least one of several other lower positions, where said cinch member is releasably retained, wherein said second end is looped through said slot and pulled down and retained by retention means, such that said cinch member will exert pulling force on said shoe laces of said shoe which are laced through said cinch member, and thereby selectively offer additional shoe lace tension, which tension can be placed on said shoe laces even after said laces are laced.

15. The quick adjusting shoe lacing system of claim 14, wherein said retention means on said strap means comprises complementary hook and loop material.

16. A shoe with a quick adjusting shoe lacing system, the shoe having an upper with medial and lateral sides, a sole, and utilizing shoe laces which are cross-laced through a plurality of spaced apart eyelet means located on medial and lateral sides in a lacing area of the shoe, said quick adjustment shoe lacing system comprising:

a cinch member having a plurality of spaced apart eyelets at an upper region, said eyelets being spaced apart by approximately the same distance as are said adjacent eyelet means in the lacing area of the shoe, wherein said cinch member is placed adjacent said upper on one of its medial and lateral sides, and said shoe laces are laced through the eyelet means of the shoe and directly through said eyelets in said adjacent cinch member without first being; laced through eyelets on the other of the medial and lateral side and;

a buckle means having lower and upper ends, said lower end being hinged at it slower end to the upper of the shoe and positioned on a first side of the shoe to releasably retain and move said cinch member from a first upper position wherein its eyelets are generally aligned with at least some of said adjacent eyelet means, to at least one of several other lower positions where said cinch member is releasably retained, whereby when said latching buckle is in a first open position, with its upper end displaced away from the upper of the shoe, the cinch plate will not be pulled downwardly, but when said latching buckle is in a closed position, with its upper end lying adjacent the upper of the shoe, said cinch plate will be pulled downwardly by said link means, and will thus exert additionally pulling force on said shoe laces looped through said cinch plate, even after said laces are laced.

17. The quick adjusting shoe lacing system of claim 16, wherein said cinch ember comprises a rigid cinch plate, and said link means comprises a wire loop which is pivotally connected at one end to said rigid cinch plate and at another end to said latching buckle.

18. The quick adjusting shoe lacing system of claim 17, wherein said latching buckle has a series of spaced apart wire loop cutouts for releasably retaining said wire loop, wherein by selecting a wire loop cutout closer to or further away from the hinging point of said latching buckle, the degree to which the cinch plate will be pulled down, and thus the degree to which the shoe lace tension will be increased can be adjusted.

* * * * *